US005265808A

United States Patent [19]

Gordon et al.

[11] Patent Number: 5,265,808

[45] Date of Patent: Nov. 30, 1993

[54] FUEL INJECTION NOZZLE FOR INTERNAL COMBUSTION ENGINES

[75] Inventors: Uwe Gordon, Stuttgart; Guenter Lewentz, Hemmingen; Detlev Potz, Stuttgart-Nord, all of Fed. Rep. of Germany

[73] Assignee: Robert Bosch GmbH, Stuttgart, Fed. Rep. of Germany

[21] Appl. No.: 978,562

[22] Filed: Nov. 19, 1992

[30] Foreign Application Priority Data

Dec. 11, 1991 [DE] Fed. Rep. of Germany ..... 4140760

[51] Int. Cl.[5] ..... F02M 61/00

[52] U.S. Cl. ..... 239/533.13; 239/533.2; 239/602; 239/DIG. 12

[58] Field of Search ..... 239/533.13, 533.12, 239/533.1, 533.2, DIG. 12, 602

[56] References Cited

U.S. PATENT DOCUMENTS

| | | | |
|---|---|---|---|
| 2,303,992 | 12/1942 | Frazer et al. | 239/533.13 |
| 2,338,679 | 1/1944 | Wood . | |
| 2,373,555 | 4/1945 | Folke | 239/533.13 |
| 3,143,293 | 8/1964 | Purse | 239/533.13 |
| 3,351,292 | 11/1967 | Stuart, Sr. | 239/533.13 |

FOREIGN PATENT DOCUMENTS

| | | | |
|---|---|---|---|
| 337351 | 5/1921 | Fed. Rep. of Germany . | |
| 339897 | 2/1934 | Fed. Rep. of Germany | 239/533.13 |
| 1186913 | 9/1959 | France | 239/533.13 |
| 100544 | 11/1920 | Switzerland | 239/533.1 |
| 157428 | 5/1922 | United Kingdom | 239/533.13 |

*Primary Examiner*—Andres Kashnikow
*Assistant Examiner*—Christopher G. Trainor
*Attorney, Agent, or Firm*—Edwin E. Greigg; Ronald E. Greigg

[57] ABSTRACT

A fuel-injection nozzle for internal combustion engines having plurality of lip elements on a nozzle tube, the edges are adjacent to each other. The lip elements form an obtuse cone and are held together under a high pre-stressing pressure by a clamping sleeve and an end cap. Pressure build-up in the interior chamber of the nozzle tube elastically expands the lip edges, in which case gaps are created, which form flat spray streams through which fuel is sprayed into the combustion chamber of the engine. When the fuel pressure in the interior chamber subsides the lip edges close to prevent any dirt from entering the slits.

10 Claims, 2 Drawing Sheets

FUEL INJECTION NOZZLE FOR INTERNAL COMBUSTION ENGINES

BACKGROUND OF THE INVENTION

The invention is based on a fuel injection nozzle as defined hereinafter.

In a nozzle of this type, known for example from DE-PS 337-351, two beak-like lip elements are clamped in a conical bore of a cylinder wall of an internal combustion engine, so that their edges are pressed o top of one another. With pressure build-up in the conical interior chamber enclosed by the lip elements, the lip elements lift away from each other like a beak, so that fuel is injected into the combustion chamber in a fan-shaped spray through the formed gap. In this case the stream has the greatest thickness in the longitudinal direction. For direct-injected Diesel internal combustion engines, which are gaining increased importance because of their low fuel consumption, a spatial distribution of the fuel into a plurality of streams located in a flat conical shell is desirable.

OBJECT AND SUMMARY OF THE INVENTION

The fuel injection nozzle according to the invention as defined by the characteristics of claim 1 has the advantage that a plurality of fine, flat injection streams permeate the highly concentrated air of the combustion chamber, in which case the fuel refined into fine drops mixes with the air, so that ignition and optimal combustion take place. Compared to the injection nozzles commonly used today, which consist of highly precise parts, such as a nozzle pin, and nozzle body, among others, an optimal conversion of pressure to speed of the fuel stream is provided because the lip elements are, at the same time, atomizing and closing mechanisms. Furthermore, the opening cross section of the slits or gaps is controlled by the line pressure, so that the cross section optimal for atomizing is always open (vario-effect). Moreover, compared to common injection nozzles, the exterior dimensions of the injection nozzle, are considerably smaller, so that new structural possibilities for the arrangement of the injection nozzles in the combustion chamber result.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
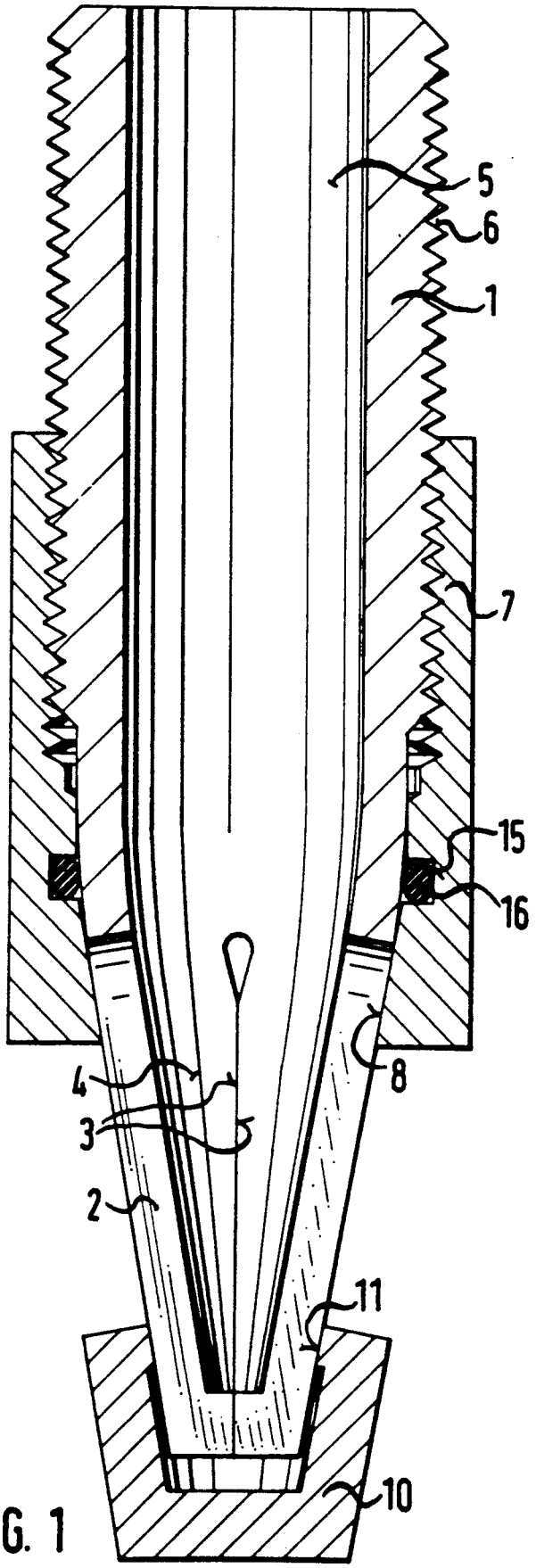
FIG. 1, shows an injection nozzle enlarged along a longitudinal section.
Figure 2:
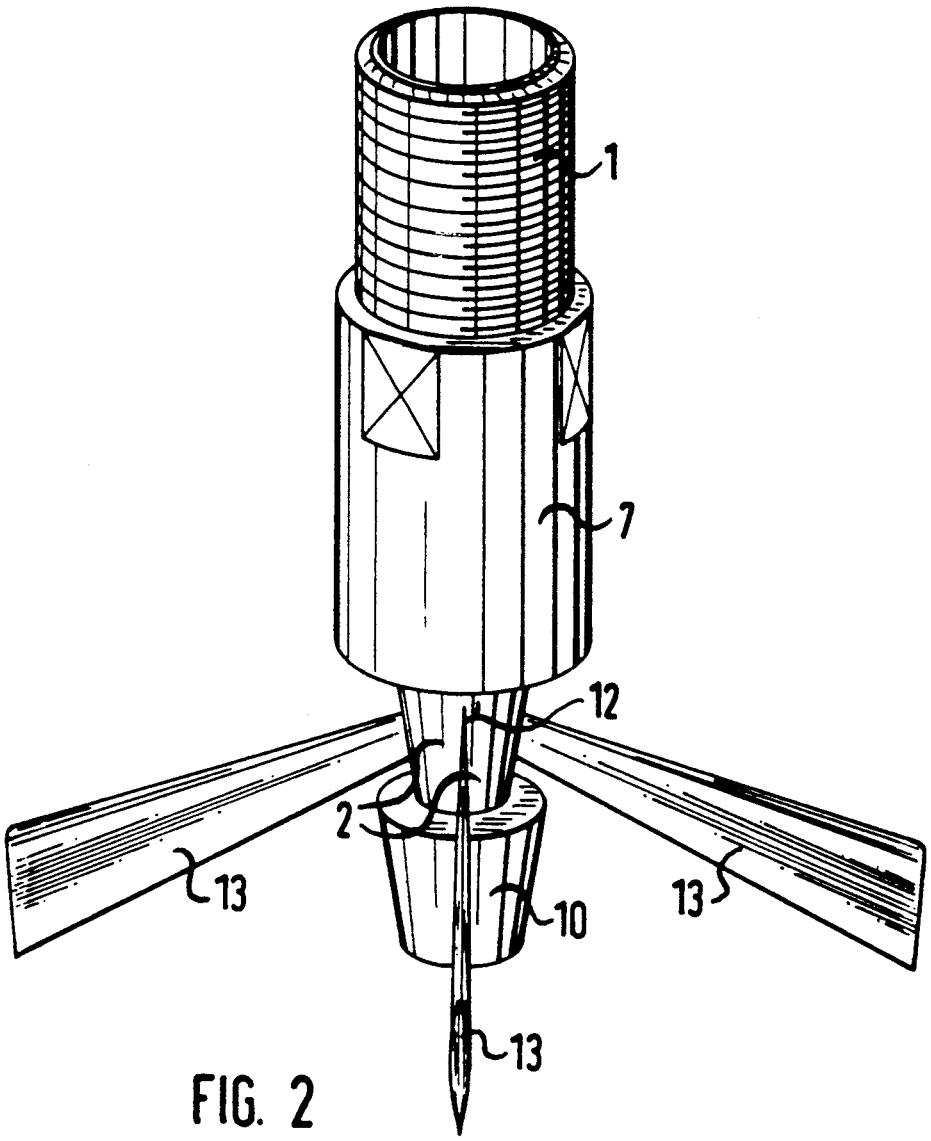
FIG. 2, the injection nozzle, in a accordance with FIG. 1, is shown in a perspective view.

A nozzle tube 1, to one end of which a fuel supply line of a fuel injection pump, not shown, is connected, is slit several times, for example four times, at the end away from the fuel injection pump so that lip elements 2 are formed. Preferably, triangular sections are cut out of the cylindrical nozzle tube 1 in an axial extension, so that in a lateral view the lip elements 2 have a trapezoidal shape. The lip elements 2 are bent radially inward on their free ends so that adjoining lateral edges 3 lie flat against each other, forming a truncated cone and enclosing an interior chamber 4, which makes a transition into the interior chamber 5 of the nozzle tube 1.

A clamping sleeve 7 is screw threaded onto an outer thread 6 of the nozzle tube 1 from the direction of the end having the lip elements 2, the lower end of the nozzle tube has an inner cone shape 8 at the end close to the lip elements 2. The lip elements 2 are held together in their frustoconical position in the vicinity of their transition into the nozzle tube 1 under great pre-stressing pressure by means of the inner cone 8, which preferably has a small inclination for self-locking. Furthermore, they are pressed together at their free ends by a cap 10, so that they closely adjoin each other with their level and smoothly worked flat edges 3 under high pre-stressing. The pre-stressing is set purposefully to the desired opening pressure.

At an open end, the cap 10 has an inwardly directed flange 11, the inside of which is also embodied to be conical, corresponding to the frustoconical angle of the adjacent connected lip elements 2, and fixes the cap 10 on the free end of the lip elements 2 in a self-looking manner. Additionally, the cap 10 can be soldered or welded to the lip elements 2. A sealing ring 16 is disposed in an annular groove 15 at the transition of the inner cone 8 into the inner thread of the clamping sleeve 7.

If fuel is fed into the nozzle tube 1 of the fuel injection nozzle, the end which dips into the combustion chamber of an internal combustion engine, high pressure builds up in the interior chamber, the middle sections of these lip elements 2, after overcoming the pre-stressing exerted by the clamping sleeve 7 and the cap 10, are elastically radially turned outward, in which case the previously tightly adjoining edges separate from each other to a slight degree. Fuel flows from the interior chamber 5 through the gaps 12 or slits created in which the fuel is formed into a thin, flat spray 13 in each of the slits 12. Because of the frustoconical shape of the lip elements 2 which form a nozzle, the formed spray stream 12 extend in an obtuse cone envelope, which is well adapted to the combustion chamber of the self-firing internal combustion engine. The fuel is finely atomized in the very thin spray streams so that upon mixing with the compressed air a highly flammable fuel-air mixture is formed. Depending on the line pressure generated, the lip elements 2 are more or less widely stretched, so that the gap 12 is correspondingly widened more or less and, depending on the pressure, the spray streams 13 are formed in accordance with the vario principle with varying thickness and width. Upon decrease of the line pressure the lip elements 2 spring back into their initial position, in which case the splits 13 again disappear and are sealed.

The spring characteristic of the lip elements 2 and, depending thereon, of the respective spray cross section, can be affected in a directed manner by the diameter, the wall thickness and the module of elasticity of the material of the nozzle tube.

What is claimed and desired to be secured by Letters Patent of the United States is:

1. A fuel-injection nozzle for internal combustion engines, said fuel injection nozzle (1) having an axially aligned interior chamber (5) with a fuel inlet end and a conical fuel outlet end, said conical fuel outlet end includes a plurality of lip elements having an end, outer surfaces and edges which form said conical fuel-outlet end, a clamping element secured onto said nozzle which forces said plurality of lip elements together so that their edges adjoin each other under tension, a closure cap (10) having an inner surface which is forced onto said conical fuel outlet end, and the ends of the lip elements (2) are spread apart under a pressure buildup in said interior chamber to provide linear slits through which fuel is sprayed.

2. A fuel-injection nozzle as defined by claim 1, in which the closure cap (10) has an inner cone (11), an angle of inclination of which is such, that the inner cone (11) forms a self-locking connection with the outer surfaces of the ends of the lip elements (2).

3. A fuel-injection nozzle as defined by claim 2, in which the inner cone (11) is disposed on an inner flange of the closure cap (10).

4. A fuel-injection nozzle as defined by claim 1, in which the lip elements (2) are connected in one piece with said nozzle (1) which extends to the fuel-inlet end.

5. A fuel-injection nozzle as defined by claim 2, in which the lip elements (2) are connected in one piece with said nozzle (1) which extends to the fuel-inlet end.

6. A fuel-injection nozzle as defined by claim 3, in which the lip elements (2) are connected in one piece with said nozzle (1), which extends to the fuel-inlet end.

7. A fuel-injection nozzle as defined by claim 4, in which said clamping element (7) is screw threaded onto the injection nozzle (1) and includes an inner cone surface (8) which clamps the ends of the lip elements (2) on the fuel outlet end together by means of the inner cone surface (8).

8. A fuel-injection nozzle as defined by claim 5, in which said clamping element (7) is screw threaded onto the injection nozzle (1) and includes an inner cone surface (8) which clamps the ends of the lip elements (2) on the fuel outlet end together by means of the inner cone surface (8).

9. A fuel-injection nozzle as defined by claim 6, in which said clamping element (7) is screw threaded onto the injection nozzle (1) and includes an inner cone surface (8) which clamps the ends of the lip elements (2) on the fuel outlet end together by means of the inner cone surface (8).

10. A method of forming a fuel injection valve which comprises forming an elongated tubular element with an axially aligned chamber, threading an outside portion of said elongated tubular element from an inlet end toward an outlet end, cutting four opposite disposed triangular shaped sections from said outlet end with an apex of said triangular section toward said outlet end, forming a clamping sleeve with a threaded inner surface end and an inner conical surface end which extends toward said threaded end portion, threading said clamping sleeve onto said elongated element with the conical end surface toward the outlet end of said tubular element therefore forcing said triangular cut portions together to form a conical outlet end, forming a closed end cap with a conical inner surface open end, and forcing said cap onto said outlet end of said conical outlet end to close any slits between said triangular portions, whereby the slits are opened upon application of fuel within said chamber under pressure to force fuel from said slits during use.

* * * * *